US006615749B2

(12) United States Patent
Wilkins

(10) Patent No.: US 6,615,749 B2
(45) Date of Patent: Sep. 9, 2003

(54) SYSTEM FOR DESTROYING DOCUMENTS

(75) Inventor: J. Larry Wilkins, Sanford, NC (US)

(73) Assignee: Schleicher & Co. of America, Inc., Sanford, NC (US)

( * ) Notice: Subject to any disclaimer, the term of this patent is extended or adjusted under 35 U.S.C. 154(b) by 0 days.

(21) Appl. No.: 10/023,352

(22) Filed: Dec. 17, 2001

(65) Prior Publication Data

US 2003/0110991 A1 Jun. 19, 2003

(51) Int. Cl.[7] ..... F23G 5/033; F23K 3/02

(52) U.S. Cl. ..... 110/233; 110/267; 110/250; 110/222; 110/101 R; 110/104 R

(58) Field of Search ..... 110/250, 233, 110/222, 346, 267, 101 R, 104 R; 109/33; 312/236; 131/231

(56) References Cited

U.S. PATENT DOCUMENTS

| | | | | | |
|---|---|---|---|---|---|
| 2,598,067 | A | * | 5/1952 | OBrien | 9/946 |
| 3,364,887 | A | * | 1/1968 | Bourner | 110/8 |
| 3,453,976 | A | * | 7/1969 | Burden et al. | 110/18 |
| 3,507,232 | A | * | 4/1970 | Ankersen | 110/8 |
| 3,613,607 | A | * | 10/1971 | Hacker | 110/18 E |
| 3,730,111 | A | * | 5/1973 | Matthews | 109/29 |
| 3,797,412 | A | * | 3/1974 | DiPaula et al. | 109/29 |
| 4,701,125 | A | * | 10/1987 | Kitchens et al. | 432/1 |
| 5,289,787 | A | * | 3/1994 | Ehelman | 110/235 |
| 5,579,704 | A | * | 12/1996 | Mansur | 110/185 |

FOREIGN PATENT DOCUMENTS

| | | | |
|---|---|---|---|
| JP | 02008608 | * | 1/1990 |
| JP | 02010015 | * | 1/1990 |
| JP | 04100580 | * | 4/1992 |

* cited by examiner

*Primary Examiner*—Ira S. Lazarus
*Assistant Examiner*—K. B. Rinehart
(74) *Attorney, Agent, or Firm*—Akerman Senterfitt

(57) ABSTRACT

The invention relates to a system for completely destroying documents having been shredded by document shredders, wherein the system comprises:

collecting means for shredded documents, burning means being arranged together with collecting means, and the burning means having a burning chamber for burning the shredded documents.

The burning chamber has an outlet with a filter unit and an air exhaust for remains of shredded documents that have been burnt.

10 Claims, 2 Drawing Sheets

SYSTEM FOR DESTROYING DOCUMENTS

TECHNICAL FIELD AND PRIOR ART

The invention relates to a system for destroying documents that have already been shredded by a document shredder.

In larger or office buildings there is a need for a plurality of office staff to have documents of critical relevance destroyed after having been read or after their use. Usually single document shredders are distributed in a building or provided in every room for documents to be shredded. The shredded documents are then collected and removed for example, by cleaning personnel. This gives the problem that the shredded documents could be put back together and their content read. Furthermore, such a system is not regarded as secure as it is not known what the cleaning personnel is doing with shredded documents.

OBJECTS OF THE INVENTION

It is an object of the present invention to provide a system for destroying documents that have been shredded by at least one document shredder wherein shredded documents are being destroyed securely and no remains are left.

It is a further object of the present invention to provide a system for destroying documents that is fit to be built in larger buildings.

According to the invention, the system includes central collecting means for shredded documents. Such central collecting means could be a pipe system or the like. Burning means are arranged together with the collecting means. This can be done in such a way that the collecting means lead to the burning means. The burning means can have one burning chamber or a number of burning chambers for burning shredded documents. The burning chamber again is connected with outlet means for the remains, or ash, of said shredded and burned documents.

Such a system provides a secure way for collecting shredded documents in that the documents are collected centrally, and then burned. As the documents are usually made of paper, they can easily be burned. Other forms of documents, such as CD's or floppy disks, can also be burned. From burned documents it is impossible to retrieve any information about their former content. Thus this method is a secure way for destroying documents even after shredding has already been provided.

According to one embodiment of the invention the burning means and the burning chamber can be adapted for burning shredded documents in a continuous process. This means that the shredded documents are being burned when they pass through the burning chamber. Such a continuous process, particularly for larger systems with a number of document shredders, allows the shredded documents to keep coming as they are being shredded. Thus the burning of shredded documents can not only be continuous, but also with no delay between shredding and burning.

According to an alternative embodiment of the invention, the burning means and the burning chamber are adapted for burning shredded documents in a non-continuous process, for example step-wise. This means that shredded documents can be collected to a certain amount or for a certain period of time and then burning is started. Collecting of shredded documents can be at any convenient place. For example, they are collected in the burning chamber itself. During such a collecting period burning should be stopped. Such a system is especially advantageous if the number of shredded documents is not so great or if they are not supplied continuously.

The burning chamber can be an enlongated channel. This provides a certain distance for shredded documents to pass through the burning chamber for better, more efficient, secure and complete burning. The burning chamber can, for example, be in the form of a pipe or the like.

According to one embodiment of the invention, the burning chamber can be equipped with burners. The burners can be gas burners. They can produce flames reaching into the burning chamber. The burning shredded documents can then be collected in or pass through the burning chamber. Gas burners are efficient and can be started easily and quickly. Of course other kinds of burners can be used within the scope of the invention.

It is also possible to heat the burning chamber where its insides are free of flames. Such a heating means can be installed in the burning chamber itself or surrounding the burning chamber. This method with an embodiment of a burning chamber being free of heating means or the like on the inside the system is very simple and secure in operation. Heating means, especially for arranging on the outside of the burning chamber and heating the burning chamber on the inside, can also incorporate electric heaters. Such electric heaters reduce the risk of explosions or fires by hazardous fuels.

The burning chamber can be connected with an exhaust system. Preferably the outlet means of the burning chamber can be connected with such an exhaust system.

Furthermore, the system or the outlet means can be connected to a separator filter. Such a filter or filter unit is preferably used for cleaning the exhaust air. According to one possible embodiment of the invention, the filter can be a fine filter unit.

The collecting means may include a vacuum stage and a pipe system. The pipe system is connected to a number of document shredders. The vacuum stage is adapted for transporting or guiding shredded documents from the document shredders to the collecting means or the burner.

Such a vacuum stage can be positioned after the burning means in the way shredded documents are taking after shredding. By this a vacuum stage can also be adapted for transporting remains of shredded documents leaving the burning chamber further along the system.

These and further features can be seen in the claims, description and drawings and the individual features. These can be both singly or in subcombinations implemented in an embodiment of the invention and in other fields. These can represent advantageous, independently protectable constructions for which protection is hereby claimed. The subdivision of the application into individual sections and subtitles does in no way limit the general validity of the statements made there under.

BRIEF DESCRIPTION OF THE DRAWINGS

Several embodiments of the invention are described in greater detail hereinafter relative to the attached drawings which show.

The view of the drawings is to be understood schematically.

DETAILED DESCRIPTION OF THE EMBODIMENTS

Figure 1:
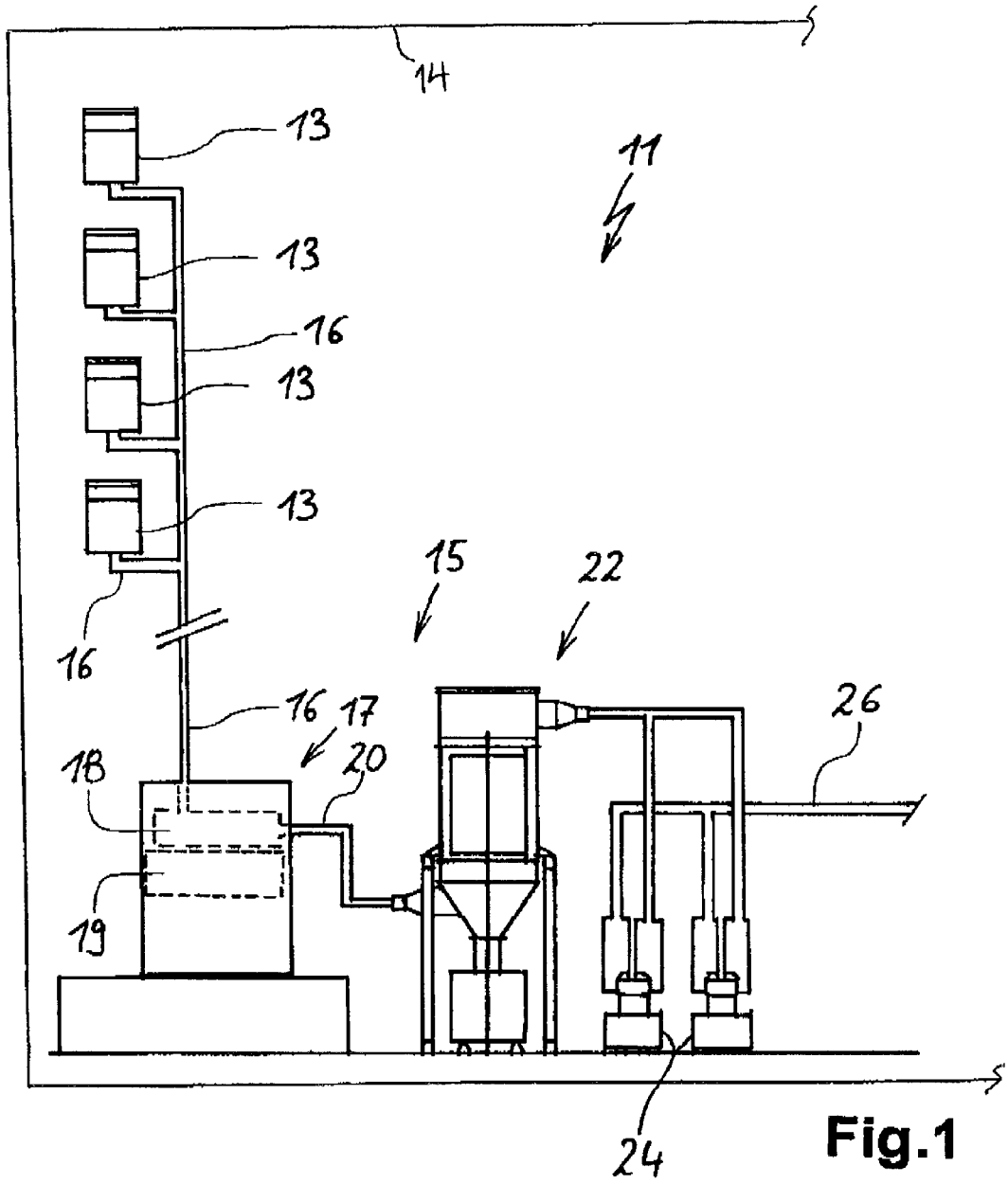
FIG. 1: a system for shredding and burning documents.

FIG. 1 shows a schematic view of a system 11 for shredding and burning documents. The system 11 comprises document shredders 13 being arranged as a plurality in a building 14 or the like. The document shredders 13 are connected with collecting means 15 via a pipe system 16. The pipe system 16 is made up of a central pipe and several pipes leading from the central pipe to the document shredders 13 in a branch-like manner.

The collecting means comprise burning means 17 with a burning chamber 18 and a burner 19 or similar burning devices. The central pipe 16 leads into the burning chamber 18.

With an outlet 20 the burning chamber 18 is connected to a fine filter unit 22 used for filtering the exhaust air of the burning chamber, specifically respective to ash or the like. Such a fine filter unit 22 is common in the art and needs not to be described in detail. The fine filter unit 22 could also be replaced by similar filtering means with the same functionality.

The fine filter unit 22 is connected via pipes to two vacuum units 24. These vacuum units 24 function as a means for transporting shredded documents from the document shredders 13 through the pipe system 16 to the burning means 17 and then to the fine filter unit 22. Furthermore, the vacuum units 24 are connected to an air exhaust 26. Such an air exhaust is also known in the art and needs not to be described in detail.

In addition to the pipe system 16 being connected to the vacuum units 24 and being used for transporting shredded documents by drawing air in, a compressor system could be provided which could be switched upstream of the pipe system 16. Using such a compression means pressurized air can be blown into the document shredders and the pipe system 16 to further enforce the shredded documents through the pipe system 16.

Figure 2:
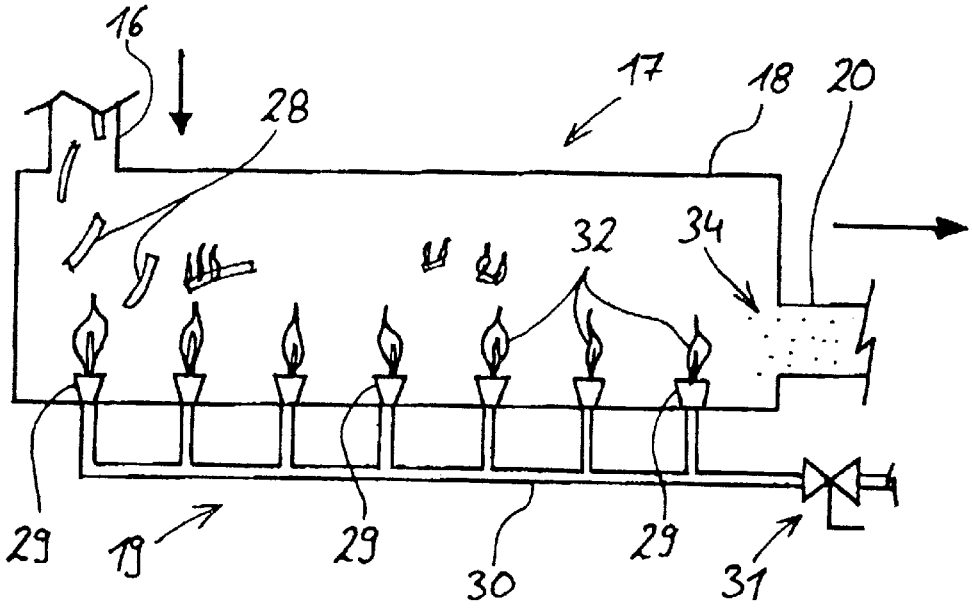
FIG. 2: an exemplary embodiment of a burning chamber with gas burners.

In FIG. 2 an examplary embodiment of burning means 17 is illustrated. Burning chamber 18 is pipe like and runs substantially in a horizontal position. On the left, the burning chamber 18 is connected to the pipe 16. On the right, burning chamber 18 is connected to the outlet means 20 in the form of another pipe.

Throughout the underside of the burning chamber 18 burners 19 are mounted. The burners 19 are gas burners 29 which reach into the burning chamber 18. The gas burners 29 are connected to a gas pipe 30 and a gas valve 31 for turning on or off the gas.

The gas burners 29 produce a plurality of flames in the form of a row or a field covering a certain area. Shredded documents 28 falling into burning chamber 18 from pipe 16 are transported through the flames 32, catch fire and are burned till they are ash 34. The ash 34 is then removed moved out of the burning chamber 18 by way of the outlet means 20.

It is to be understood from FIG. 2, that gas burners or other burning means producing flames can be arranged in many ways.

Figure 3:
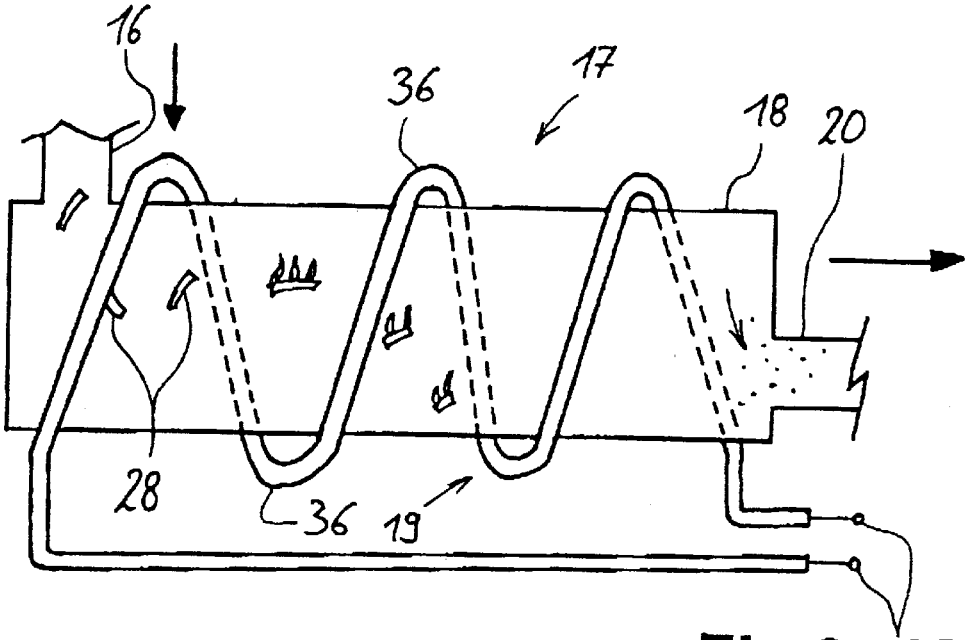
FIG. 3: another embodiment of the burning means with electric heating.

In FIG. 3 an alternative embodiment of burning means 17 is illustrated. Burning chamber 18 is constructed similarly to the one in FIG. 2. Instead of gas burners 29, an electric heater 36 in the form of a long pipe is provided. The electric heater surrounds the burning chamber 18 in screw-like manner. Alternatively, it is possible to provide an electric heater substantially underneath the burning chamber 18 or even inside the burning chamber 18. The electric heater 36 is connected to electric connectors 37 which have a similar function to gas valve 31 in FIG. 2. Via the connectors 37 the electric heater 36 can be energised.

With the electric heater 36 it is possible to heat the inside of burning chamber 18. This can be in such a way that shredded documents 28 catch fire and are burnt to ash 34. Alternatively, it is possible to transform shredded documents 28, for example paper, directly into ash by heating only without any flames.

The ash 34 is removed through outlet means 20 to the filter unit 22. The burning means 17 illustrated in FIGS. 2 and 3 are adapted for burning shredded documents in a continuous process. For burning shredded documents in a non-continuous process, it is possible to collect a certain amount of shredded documents in a position located prior to the burning chamber 18. After having collected a certain amount of shredded documents they can be transported into the burning chamber 18*b* and be burned.

It is possible to collect a certain amount of shredded documents inside burning chamber 18 and then start the burner 19. The choice between a continuous and a non-continuous process depends largely on the kind of documents or material of the documents to be shredded, the number of document shredders and several further aspects.

What is claimed is:

1. A system for destroying documents having been shredded by a plurality of document shredders which are connected via a pipe system, said system comprising:

a plurality of document shredders distributed in a building;

central collecting means for said shredded documents, including said pipe system; and burning means arranged together with said collecting means, said burning means having at least one burning chamber for burning said shredded documents, wherein said burning chamber has outlet means for remains of said burnt shredded documents.

2. System according to claim 1, wherein said burning means and said burning chamber are adapted for burning said shredded documents in a continuous process, wherein said shredded documents are be burnt when passing through said burning chamber.

3. System according to claim 1, wherein said burning means and said burning chamber are adapted for burning said shredded documents stepwise in a non-continuous process.

4. System according to claim 3, wherein an amount of said shredded documents is collected in said burning chamber and is removed by way of said outlet means after having been burnt.

5. System according to claim 1, wherein said burning chamber is an elongated channel in the form of a pipe.

6. System according to claim 1, wherein said burning chamber is equipped with burners, said burners producing flames and said flames reaching into said burning chamber for burning said shredded documents.

7. System according to claim 1, wherein said burning chamber is heated by electric heating.

8. System according to claim 1, wherein said burning chamber is connected with a separator filter via said outlet means.

9. System according to claim 1, wherein said central collecting means include a vacuum stage, said vacuum stage adapted for transporting said shredded documents from said document shredders to said collecting means.

10. System according to claim 9, wherein said vacuum stage is positioned after said burning means in the way of said shredded documents.

* * * * *